US005673714A

United States Patent [19]

Campagnolo et al.

[11] Patent Number: 5,673,714

[45] Date of Patent: Oct. 7, 1997

[54] DISHWASHER WITH REVERSIBLE ROTATING SPRAY AGITATOR

[75] Inventors: Flavio Campagnolo, Conegliano; Dino Munini, S. Quirino, both of Italy

[73] Assignee: Electrolux Zanussi Elettrodomestici S.p.A., Pordenone, Italy

[21] Appl. No.: 490,279

[22] Filed: Sep. 14, 1995

[30] Foreign Application Priority Data

Jun. 16, 1994 [IT] Italy ..... PN94U0022

[51] Int. Cl.[6] ..... B08B 3/02

[52] U.S. Cl. ..... 134/57; 134/176; 134/179; 239/251; 239/265.19

[58] Field of Search ..... 134/560, 570, 134/580, 179, 176, 198, 201; 239/265.19, 251, 255, 258, 256, 222.17

[56] References Cited

U.S. PATENT DOCUMENTS

| | | | |
|---|---|---|---|
| 1,408,077 | 2/1922 | Clinton | 239/255 |
| 1,733,249 | 10/1929 | Clinton | 134/179 |
| 1,798,488 | 3/1931 | Orr | 239/251 |
| 2,201,710 | 11/1940 | Wilson | 239/193.5 |
| 3,160,164 | 12/1964 | Constance et al. | 134/176 |
| 3,596,834 | 8/1971 | Cushing | 239/251 |
| 3,771,725 | 11/1973 | Jenkins et al. | 134/176 |
| 3,797,509 | 3/1974 | Fukuzawa et al. . | |
| 4,221,333 | 9/1980 | Rodriguez | 239/255 |
| 4,884,585 | 12/1989 | Oh | 134/176 |

FOREIGN PATENT DOCUMENTS

| | | | |
|---|---|---|---|
| 152390 | 7/1953 | Australia | 239/222.17 |
| 0053231 | 6/1982 | European Pat. Off. . | |
| 4020899 | 1/1992 | Germany . | |
| 410310 | 10/1966 | Switzerland | 134/179 |

*Primary Examiner*—Frankie L. Stinson

*Attorney, Agent, or Firm*—Pearne, Gordon, McCoy & Granger LLP

[57] ABSTRACT

A dishwasher has a spray agitator (1) rotating about an axis (2) and fed with water under pressure so as to emit several water jets. A rotating pressure jet (10) periodically reverses the direction of rotation of the agitator (1). The dishes are washed efficiently even if a mechanical obstruction interferes with the agitator (1).

5 Claims, 2 Drawing Sheets

DISHWASHER WITH REVERSIBLE ROTATING SPRAY AGITATOR

BACKGROUND OF THE INVENTION

The present invention concerns a dishwasher, in particular of the domestic type, provided with at least one improved agitator to spray dishes supported in a suitable basket.

As is known, agitators of a dishwasher rotate due to the effect of reactions caused by water jets coming out of respective pressure nozzles. The pressure nozzles are normally fixed so as to emerge from the agitator, which then rotates in a predetermined direction. Obviously, the agitators also include nozzles that spray dishes, which can be fixed and/or rotating. In any case, the spray nozzles do not substantially effect the rotation of the agitator.

In some cases,dishes, incorrectly positioned in the dishwasher, interfere with and block the agitator. This compromises the results of washing and the machine may be insufficiently cooled because of the thermal resistance of the water. To eliminate these inconveniences, dishwashers have been proposed in which there is an electromagnetic sensor capable of activating an alarm device if an agitator rotates below a predetermined speed, as described for example in EP 0,053,231.

A similar mechanical solution is described, for example, in DE 4,020,899, in which a valve device and a blocking device are capable of reducing the rotation of the agitator, permitting the washing program to proceed only if the agitator itself is not interfered with by the dishes during an initial "exploratory" rotation. If there is interference, the functioning of the dishwasher is interrupted or an alarm device is activated.

Such solutions are unduly complicated and costly, and in any case they do not solve the functional problems arising from a possible blockage of the agitator. They are limited to signaling the blockage, so that the user can intervene appropriately to restore a condition of proper functioning.

A more effective solution that operates automatically is described in U.S. Pat. No. 3,797,509, in which the direction of rotation of the agitator in a dishwasher can be reversed by means of using a spherical bi-stable commutation valve that selectively feeds opposing pressure nozzles provided on the agitator. The alternating commutations of the spherical valve are controlled according to a preset program by means of suitable pauses in the functioning of the pump that feeds the agitator. Therefore, repeated reversals of the direction of rotation of the agitator require corresponding pauses of the pump and the corresponding drag motor, as well as a suitable programming system for the machine. As a result, the hydraulic noise caused by the intermittent functioning of the pump is unduly high, the drag motor is subject to repeated demands, which reduce its lifetime, and programming of the machine requires a relatively complex system. Moreover, the spherical commutation valve has a critical function and an unduly complicated structure.

SUMMARY OF THE INVENTION

The purpose of the present invention is to provide a simple and reliable dishwasher with at least one rotating spray agitator, capable of performing an efficient washing of dishes even in the case where the dishes interfere incorrectly with the agitator itself, without the necessity of using complicated auxiliary devices to control the rotation of the agitator.

According to the invention, this purpose is achieved in a dishwasher with a rotating spray agitator incorporating the characteristics of the attached claims.

BRIEF DESCRIPTION OF THE DRAWINGS

The characteristics and advantages of the invention will be clarified by the following description, which is given only as a non-limiting example, with reference to the diagrams, in which.

DETAILED DESCRIPTION OF THE PREFERRED EMBODIMENTS

Figure 1:
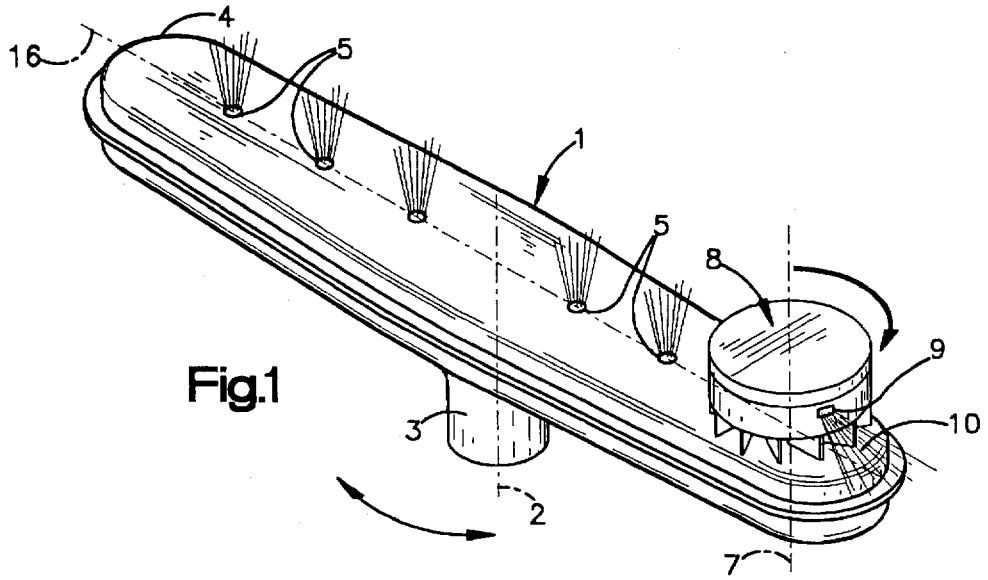
FIG. 1 shows schematically in perspective a rotating spray agitator of a dishwasher according to a first embodiment.
Figure 2:
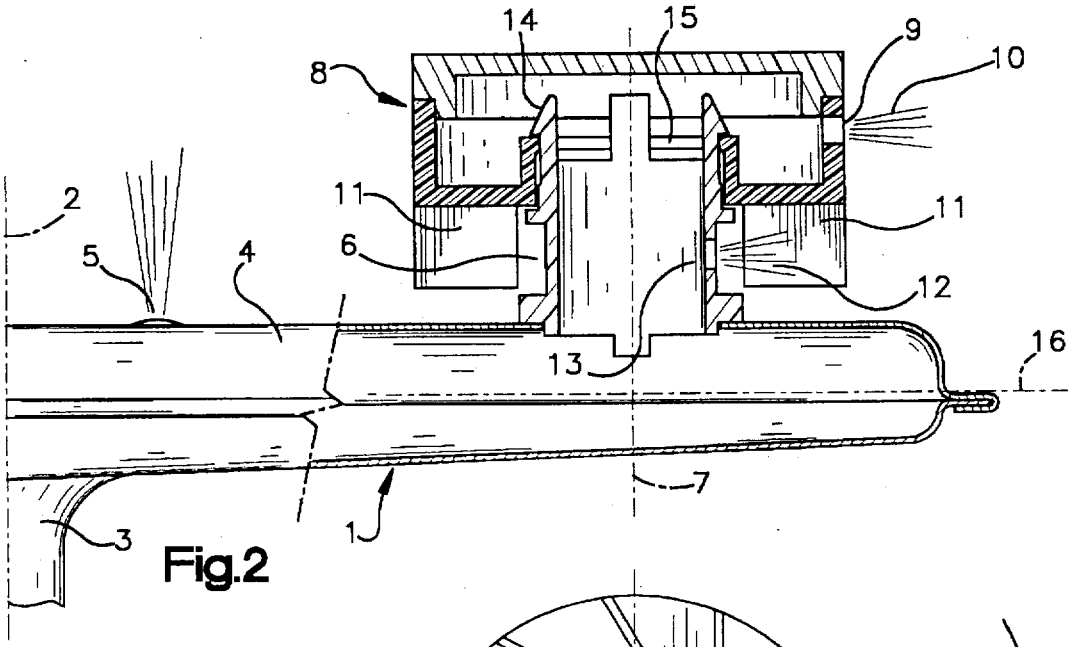
FIG. 2 shows schematically in section an enlarged detail of FIG. 1.
Figure 3:
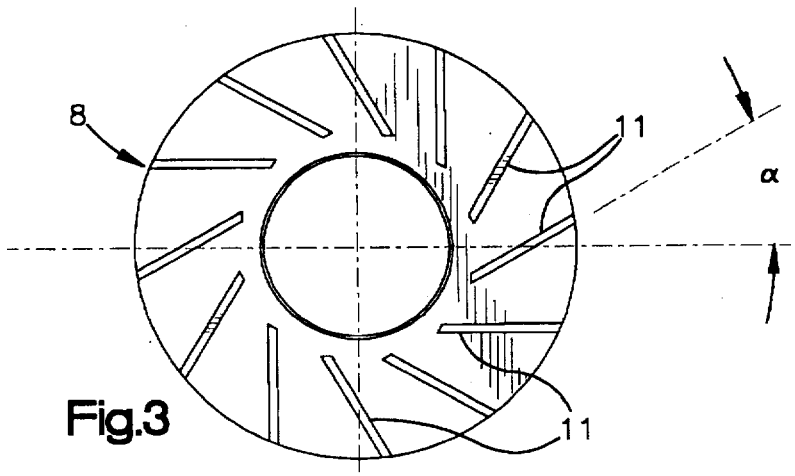
FIG. 3 shows a bottom view of a component of the detail of FIG. 2.

With reference to FIGS. 1 through 3, a dishwasher includes a wash basin in which, in a substantially traditional manner, at least one agitator 1 is located. The agitator is adapted for rotating about a substantially vertical axis 2 in order to spray water on dishes placed in an associated basket (not shown) above the agitator.

The agitator 1 can be fed with water under pressure (provided by a circulating pump, not shown) through a central supply conduit 3. Preferably the agitator has two opposing radial arms 4 extending from the conduit 3. Obviously, the agitator 1 can comprise one or more radial arms 4, as required. In any case, the agitator 1 includes several nozzles 5, preferable fixed, capable of producing corresponding water jets for washing the dishes.

Rotation of the agitator 1 about its own axis 2 occurs because of hydraulic reaction, in a manner that will be described below. In particular, the agitator 1 is provided with a hydraulic pressure device capable of reversing the direction of rotation of the agitator 1 periodically in such a way that a possible blockage of the agitator against a mechanical obstacle will only be temporary, until the agitator reverses its own direction of rotation. In such a case, the agitator will perform a series of partial rotations (about 180° in the case of two opposing arms 4) in alternating directions, with the result that the washing jets emitted by the nozzles 5 will still cover an angle of rotation that is substantially equal to 360°. In actuality, the result of the washing and a homogeneous "bathing" of the heating elements will be substantially sufficient even in the case where a mechanical obstacle interferes with the rotating agitator 1.

Preferably, the above-mentioned pressure device, capable of reversing the direction of rotation of the agitator 1 comprises the same devices that cause rotation by hydraulic reaction. More precisely, the agitator 1 includes a substantially cylindrical tube 6 that emreges from the agitator along an axis 7. The axis 7 is substantially parallel to and staggered or offset with respect to the axis of rotation 2 and preferably extends through one end of the agitator 1.

A hollow rotor 8 is journalled so as to freely rotate on a free end of the tube 6. The hollow rotor 8, preferably disk-shaped, watertight, and has a side wall with at least one passageway 9.

The passageway 9 defines a pressure nozzle capable of emitting a water jet 10 that rotates about the axis of rotation 7 of the rotor 8. A lower wall of the rotor 8 is shaped in the form of a turbine, with blades 11 driven or inpinged by at least one water jet 12 emerging from a calibrated hole or an activating nozzle 13 provided in the tube 6. The blades 11 are preferably inclined, as shown in FIG. 3. The rotor 8 is preferably mounted on the tube 6 as a unit, which is provided with small engaging teeth 14 capable of being inserted elastically into a central hole 15 in the lower part of the rotor 8, as shown in FIG. 2.

In operation, the water under pressure that flows into the agitator 1 through the conduit 3 feeds not only the washing nozzles 5, but also the activating nozzle 13 and the pressure nozzle 9 through the tube 6 and the hollow rotor 8. Thus the activating nozzle 13 makes the rotor 8 rotate about axis 7 in a direction and with a velocity that are determined by the inclination of the blades and by the force exerted by the activating jet 12. Consequently, the water jet 10 emitted by the pressure nozzle 9 rotates in a single direction together with the rotor 8, making the agitator 1 rotate about axis 2 by hydraulic reaction, in a direction that will be reversed periodically. More precisely, the pressure exerted by the rotating jet 10 makes the agitator 1 rotate alternately through corresponding symmetrically opposed angles of 180° with respect to a longitudinal axis 16 of the agitator. Obviously, the tangential component of the pressure exerted by the jet 10 varies continually between a minimum and a maximum, with two opposite "dead" times when the jet 10 and pressure nozzle 9 are in line with the longitudinal axis 16.

These "dead" times are essentially negligible for purposes of correct operation of the agitator 1. The dead times can, however, be further minimized by increasing an inclination $\alpha$ (FIG. 3) of the blades 11 that are positioned angularly on the rotor 8 so as to correspond to the axis of the activating nozzle 13 when the pressure nozzle 9 is substantially in line or parallel with the longitudinal axis 16 of the agitator. In this way, the rotational velocity of the rotor 8 is increased momentarily at the "dead" pressure points.

Preferably, the various components will be dimensioned by the field technician in such a way that under normal operating conditions, reversal of the direction of rotation of the agitator 1 occurs after the agitator itself has made a rotation in the opposite direction sufficient to guarantee complete coverage of at least 360° by the washing jets that emerge from the nozzles 5.

Figure 4:
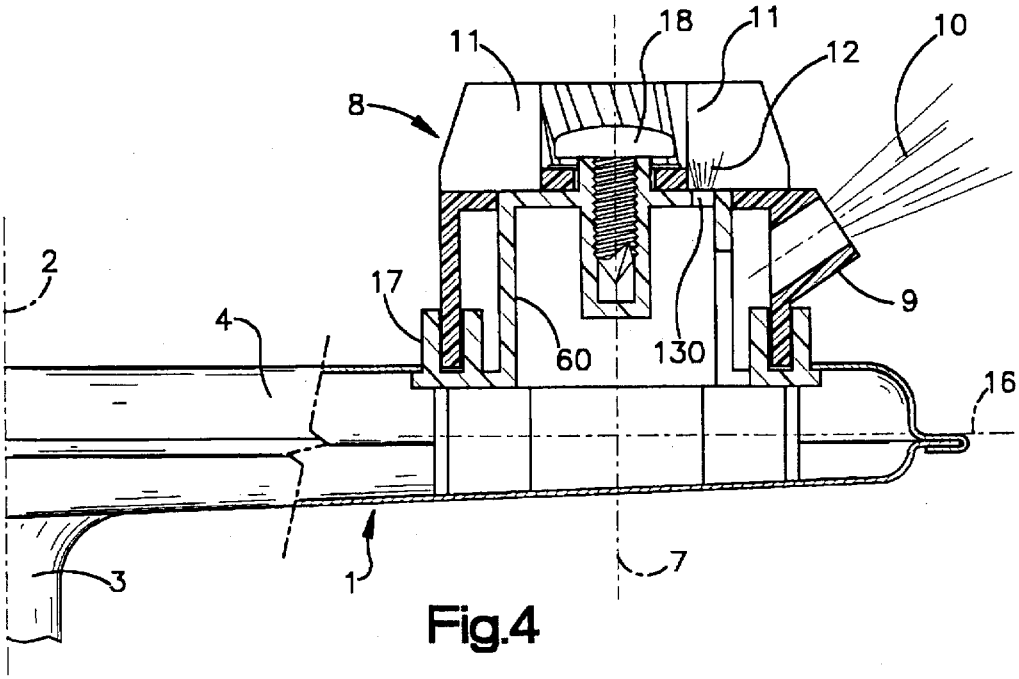
FIG. 4 shows the detail of FIG. 2 in a second embodiment.
Figure 5:
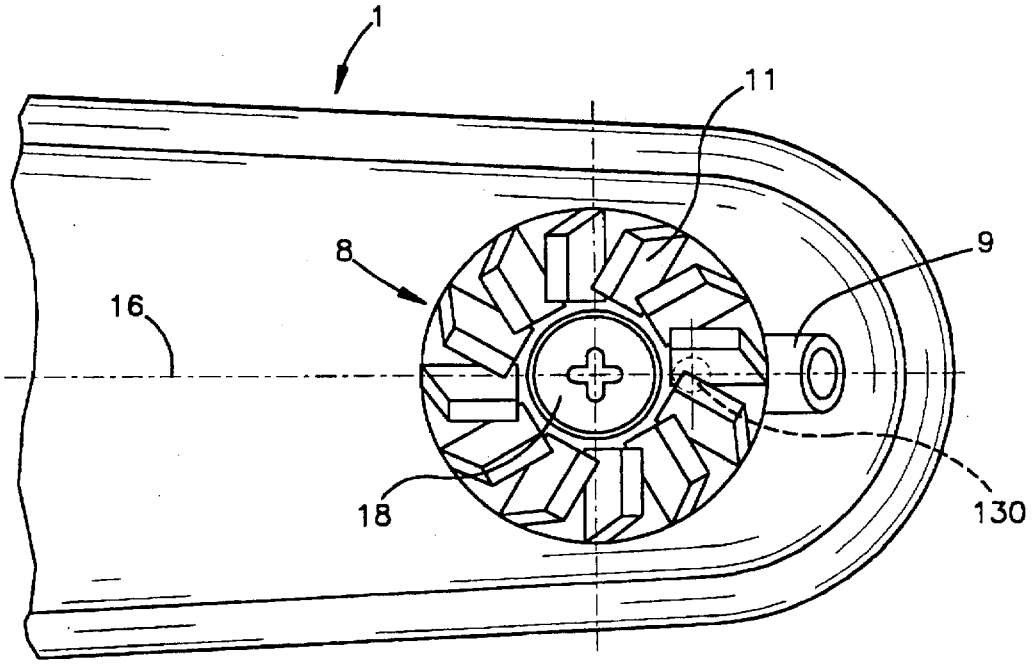
FIG. 5 shows a top view of the detail of FIG. 4.

Better hydraulic efficiency is obtained in the embodiment shown in FIGS. 4 and 5, the operation of which is substantially identical to that described in the preceding. In this second embodiment, the pressure nozzle 9 is inclined upward (i.e., oriented toward the dishes to be washed, not shown), in such a way that the water jet 10 that emerges from it not only causes the rotor 8 to rotate, but also contributes to the washing of the dishes.

Preferably, moreover, the blades 11 are placed on the upper part of the rotor 8. The rotor extends downwardly in an essentially cylindrical configuration that is inserted at the bottom in a ring-shaped guide 17 so as to rotate freely therein. The rotor is assembled over an essentially cylindrical blind tube 60 provided with at least one calibrated hole or activating nozzle 130, capable of emitting a corresponding activating jet 12 directed toward the blades 11. The rotor 8 is maintained in axial position with respect to the tube 60 by means of an attachment screw 18 or something similar.

As said before, the general operation of the agitator 1 is substantially identical to that described with reference to FIGS. 1 through 3, with the difference that the activating jet 12 also reaches the dishes, after having struck the blades 11, contributing to the washing of the dishes themselves.

What has been described makes evident the constructive and functional simplicity, and thus the reliability, of the dishwasher in which alternating reversal of the direction of rotation of the agitator i can be obtained advantageously in a periodic mode, with uninterrupted operation of the circulation pump. Obviously, the dishwasher described can undergo numerous modifications within the scope of the invention.

What is claimed is:

1. A dishwasher comprising at least one spray agitator adapted for rotating about a substantially vertical axis (2) and adapted for being fed with water under pressure to emit several water jets; and a hydraulic pressure device for alternately reversing a direction of rotation of the agitator, characterized by the fact that said hydraulic device comprises a hollow rotor (8) that is journalled on the agitator (1) and having an axis of rotation (7) offset with respect to the axis of rotation (2) of the agitator; at least one pressure nozzle (9) disposed on the rotor and adapted for emitting a water jet (10) that rotates around the axis of rotation (7) of the rotor; and a tube (6;60) that emerges from the agitator (1); said tube having the rotor journalled thereon and provided with at least one activating nozzle (13;130) adapted for emitting a water jet (12) directed against several inclined blades (11) located on the rotor (8) in such a way as to make the rotor rotate in a single direction.

2. A dishwasher according to claim 1, characterized by the fact that said hydraulic pressure device (9) is adapted for reversing the direction of rotation of the agitator (1) after the agitator has completed at least one complete rotation about the axis (2) of the agitator.

3. A dishwasher according to claim 1, characterized by the fact that the blades (11) correspond to an axis of the activating nozzle (13) when the pressure nozzle (9) is substantially in line with a longitudinal axis (16) of the agitator (1) and have an inclination ($\alpha$) greater than other blades so as to increase temporarily a rotational velocity of the rotor (8) at dead times of the pressure used to reverse the agitator.

4. A dishwasher according to claim 1, characterized by the fact that said pressure nozzle (9) is directed toward dishes to be washed.

5. A dishwasher according to claim 1, characterized by the fact that the water jet (12) directed against the blades (11) of the rotor (8) is also directed toward dishes to be washed.

* * * * *

UNITED STATES PATENT AND TRADEMARK OFFICE

CERTIFICATE OF CORRECTION

PATENT NO. : 5,673,714
DATED : October 7, 1997
INVENTOR(S) : Campagnolo et al.

It is certified that error appears in the above-indentified patent and that said Letters Patent is hereby corrected as shown below:

On the title page,

In Section [22], delete "Filed: Sep. 14, 1995" and insert --Filed: Jun. 14, 1995".

Signed and Sealed this

Twenty-eighth Day of April, 1998

Bruce Lehman

*Attest:*

BRUCE LEHMAN

*Attesting Officer*

*Commissioner of Patents and Trademarks*